United States Patent [19]

Bishop

[11] Patent Number: 5,052,850

[45] Date of Patent: Oct. 1, 1991

[54] RESILIENT SAFETY EXTENSION FOR HIGHWAY BARRIERS

[76] Inventor: Robert J. Bishop, 1083 Bloomfield Ave., West Caldwell, N.J. 07006

[21] Appl. No.: 554,672

[22] Filed: Jul. 17, 1990

[51] Int. Cl.[5] ..... E01F 15/00

[52] U.S. Cl. ..... 404/6; 404/10

[58] Field of Search ..... 404/6, 10

[56] References Cited

U.S. PATENT DOCUMENTS

| | | | |
|---|---|---|---|
| 4,007,917 | 2/1977 | Brubaker | 404/6 X |
| 4,303,349 | 12/1981 | Upton | 404/6 |
| 4,348,133 | 9/1982 | Trent et al. | 404/6 |
| 4,353,106 | 3/1984 | Förster et al. | 404/6 |
| 4,681,302 | 7/1987 | Thompson et al. | 404/6 X |
| 4,869,617 | 9/1989 | Chiodo | 404/6 |
| 4,917,219 | 4/1990 | Henry | 404/6 X |
| 4,925,333 | 5/1990 | Bishop | 404/6 |
| 4,946,306 | 8/1990 | Yodock | 404/6 |
| 4,978,245 | 12/1990 | White | 404/6 |

*Primary Examiner*—Ramon S. Britts
*Assistant Examiner*—Nancy Connolly
*Attorney, Agent, or Firm*—Howard E. Thompson, Jr.

[57] ABSTRACT

A resilient safety extension is provided for highway barriers of the type having a broad base and upstanding central portion with opposed convergently tapered surfaces and a length which is infinitely variable, in the form of an elongated resilient member having an inverted generally U-shaped transverse configuration provided by a top portion and spaced downwardly extending portions adapted to straddle the upstanding portion of the highway barrier, the downwardly extending portions being convergently tapered to provide inner surfaces closely interfitting with the upstanding portion of the barrier and outer surfaces which are slightly divergent in the direction of the top portion, and the thickness of the downwardly extending portions being variable by amounts of the order of 2 inches to provide sinusoidally curved outer surface patterns, repeating at approximately 24" intervals longitudinally of the safety extension. The safety extension is preferably prefabricated in unit lengths of four feet to six feet by the blow-molding or rotation-molding of appropriate plastic material to form hollow bodies with resilience controlled by the wall thickness and the plastic material employed. Alternatively, the safety extensions can be fashioned as solid bodies of foamed plastic material with resilience provided by the nature of the material and extent of foaming. With either type of construction the sinusoidally curved surfaces and resilient characteristics provide effective warning to the motorist of a glancing contact with the barrier without the type damage associated with directly contacting a concrete barrier.

16 Claims, 2 Drawing Sheets

RESILIENT SAFETY EXTENSION FOR HIGHWAY BARRIERS

This invention relates to a resilient safety extension or attachment for conventional highway barriers or dividers normally fashioned from molded concrete, and having a flared base, and upstanding central portion with opposed surfaces being slightly convergent to provide reduced thickness at the top of the barrier. Such barriers are generally about 30 to 36 inches high, and 16 to 18 feet in length, and assembled in end to end relation provide effective guides and dividers for lanes of highway traffic. The size and weight of such barrier sections makes it difficult to move and realign the sections to accomodate changing conditions. They are also inherently dangerous in that even a glancing contact by a moving vehicle can so damage the vehicle as to escalate a minor incident to a major accident, with vehicles occasionally being overturned, or even caused to climb and jump over the barrier.

In my prior application, Ser. No. 186,984 filed July 31, 1989, since issued as U.S. Pat. No. 4,925,333 dated May 15, 1990, and Ser. No. 509,209 filed Apr. 16, 1990 there have been disclosed approaches to these highway barrier problems. In these approaches, relatively short longitudinal sections in the form of plastic shells having end to end interengagement, and adapted to be filled with suitable weighting material, such as sand, cement or water, facilitate easy movement when barrier relocation is desired. These approaches include in the assembly, laterally protruding resilient members providing the motorist with a physical and audible warning signal in the event of glancing contact, to thereby minimize the chance of more direct and damaging contact with the barrier structure.

In the first of these prior applications, the protruding resilient members are sperical plastic balls, rotatably mounted in cooperating spherically curved recesses in the barrier components.

In the second of the prior applications the protruding resilient members are vertically oriented plastic cylinders rotatably mounted in appropriate recesses spaced longitudinally of the opposed surfaces of the assemblage. In the latter instance, a modified adaptation involves providing slightly divergent orientation of resilient cylinders at opposed surfaces of the assemblage to limit or restrict the tendency of a contacting vehicle to climb the barrier.

While the improvements of said prior applications provide distinct advantage for the temporary or transient barriers and lane guides as used around construction and repair sites and the like, it will be apparent that there are instances, as in the lane dividers of major highways where the weight and density of the conventional molded concrete barriers remains imperative, in spite of the safety hazards earlier mentioned.

THE INVENTION

In accordance with the present invention the safety and warning features above described have been extended to heavy permanent concrete barriers by providing for such barriers a resilient extension built up of similar extension units which are assembled in end to end relation. Regarded in certain of its broader aspects, the resilient safety extension of the present invention, which is adapted for use on highway barriers of the type having a broad base and upstanding central portion with opposed convergently tapered surfaces and a length which is infinitely variable, comprises an elongated resilient member having an inverted generally U-shaped transverse configuration provided by a top portion and spaced downwardly extending portions adapted to straddle the upstanding portion of the highway barrier, the downwardly extending portions being convergently tapered to provide inner surfaces closely interfitting with the upstanding portion of the barrier and outer surfaces which are slightly divergent in the direction of the top portion, and the thickness of the downwardly extending portions being variable by amounts of the order of 2 inches to provide sinusoidally curved outer surface patterns, repeating at approximately 24" intervals longitudinally of the safety extension.

The safety extension is preferably prefabricated in unit lengths of four feet to six feet by the blow-molding or rotation-molding of appropriate plastic material to form hollow bodies with resilience controlled by the wall thickness and the plastic material employed. Alternatively, the safety extensions can be fashioned as solid bodies of foamed plastic material with resilience provided by the nature of the material and extent of foaming. With either type of construction the sinusoidally curved surfaces and resilient characteristics provide effective warning to the motorist of a glancing contact with the barrier without the type damage associated with directly contacting a concrete barrier.

The resilient safety extension units are assembled to a highway barrier in abutting end to end relation so as to form, in effect, a continuous resilient extension throughout the complete barrier length. While an interlock or joining can be provided, if desired, between successive extension units of a longitudinal assemblage, it is considered preferable to have the successive units merely abut one another and to securely affix each unit to the permanent barrier. This can be accomplished by cementing the units in place, or by providing a plurality of bolts or other fasteners. Such independent mounting of units which are abutting one another in assemblage facilitates easy removal and replacement of individual or multiple units which may be damaged by vehicle contact.

When fabricating the resilient extensions as molded bodies, the use of foamed plastic material as above mentioned is but one of a number of avilable options, depending upon the nature of the resilient plastic material being employed. The provision of small voids uniformly distributed throughout the mass is one of the factors facilitating control of the resilient characteristics.

When fabricated by a foaming process these voids will have a generally cylindrical contour. On the other hand, when bonding together a particled scrap material, the voids will be of infinitely varied contour. If the construction material were to be ground-up discarded tires, held together with a suitable bonding agent, the voids could be quite small, with the desired resilience being provided primarily by the inherent resilience of the particled tire material.

When fabricating the safety extensions as solid bodies by any of the procedures above described, the length can be varied within the general range of 4 to 8 feet, but in each instance the molded body should contain a whole number of the sinusoidally curved contours, with the centers of concave portions thereof being located at the ends of the units so that end to end assemblage provides a uniformly repeating sinusoidally curved contour.

It is also within the scope of the present invention to produce the solid body form of extension in a continuous molding operation at the barrier site. This would entail the use of specially devised equipment straddling the barrier, and having movable belts to form a mold chamber providing the desired external contours for the safety extension. In such equipment the movement of the belts would be synchronized with the forward movement of the equipment, and the belts would be of sufficient lengths to permit the material being molded to sufficiently set or cure so as to maintain structural integrity as it leaves the advancing mold chamber.

Repair of such continuously molded extension, as necessary from time to time due to vehicular contact, can be accomplished by cutting out an appropriate length of extension to permit insertion of one or more preformed extension units of the type previously described.

When fashioning the safety extensions as hollow bodies by the rotation-molding or blow-molding techniques, a central aperture in the top surface will be formed in the molding operation. This aperture is provided with a removable closure to permit filling of the hollow body with water, which should, of course, contain anti-freeze if the safety extension is to be used in areas subject to sub-freezing temperatures. The water filling will not only add weight to the safety extension, but also enhance the resilient characteristics as the unit may be subjected to glancing contact by a moving vehicle.

The closure means can also be provided with a conventional air valve permitting the unit to be filled with compressed air at appropriate pressures. While the compressed air filling does not provide the advantage of added weight, it does permit significant control of the resilient characteristics, and the manner in which the unit will respond to glancing contact by a moving vehicle.

As an added safety feture the plastic material of the resilient extension can be color characterized by incorporating appropriate coloring agent in the plastic, or applying it as a coating. For optimum effectiveness such coloring agent can be of the florescent type, the intensity of which is enhanced by approaching automotive headlights.

The resilient safety extension of the present invention will be more fully understood from consideration of the following description, having reference to the accompanying drawing in which various parts of the device have been identified by suitable reference characters in the several views, and in which.

Figure 1:
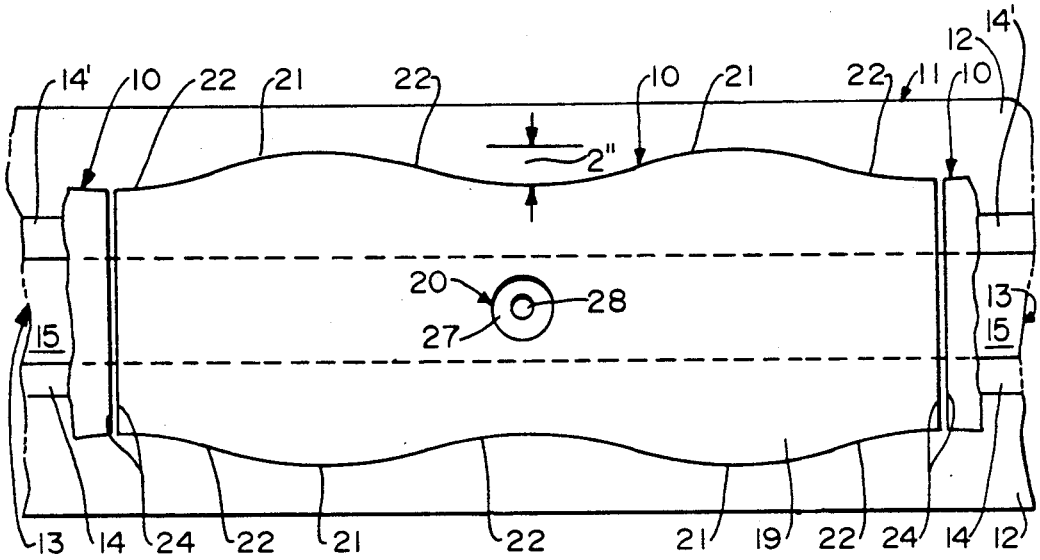
FIG. 1 is a top view of a unit of the resilient safety extension as on a highway barrier.

As shown in the drawing, the resilient safety extension 10 is mounted on a conventional highway barrier 11, generally molded from concrete; and having a flared base 12 and an upstanding central portion 13, having convergently tapered opposed surfaces 14, 14' which provide a relatively narrow top surface 15. The resilient safety extension 10 is is a molded hollow plastic body, suitably fashioned from polyethylene or other plastic material by the blow-molding or rotation-molding technique, and having what may be considered a generally inverted U-shaped cross sectional contour for straddling the upstanding barrier portion.

Figure 3:
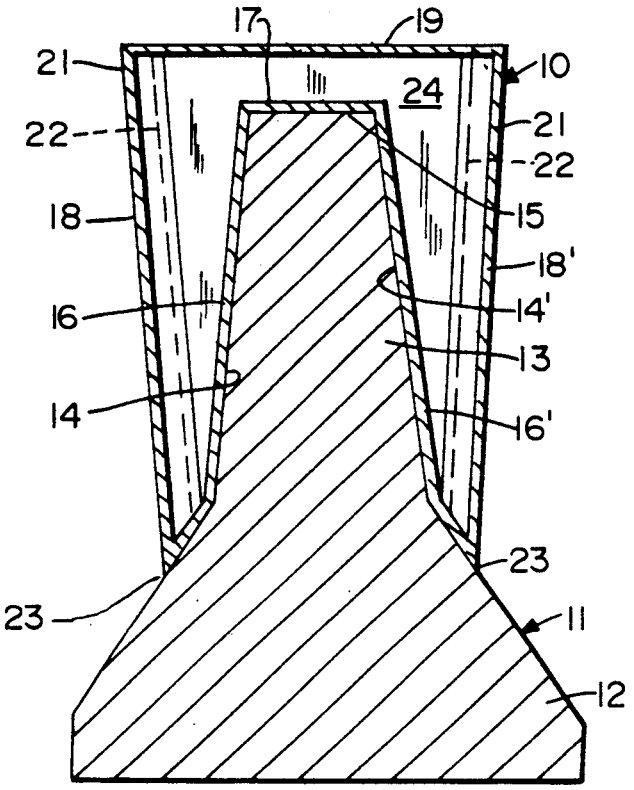
FIG. 3 is a sectional view on the line 3—3 of FIG. 2.
Figure 4:
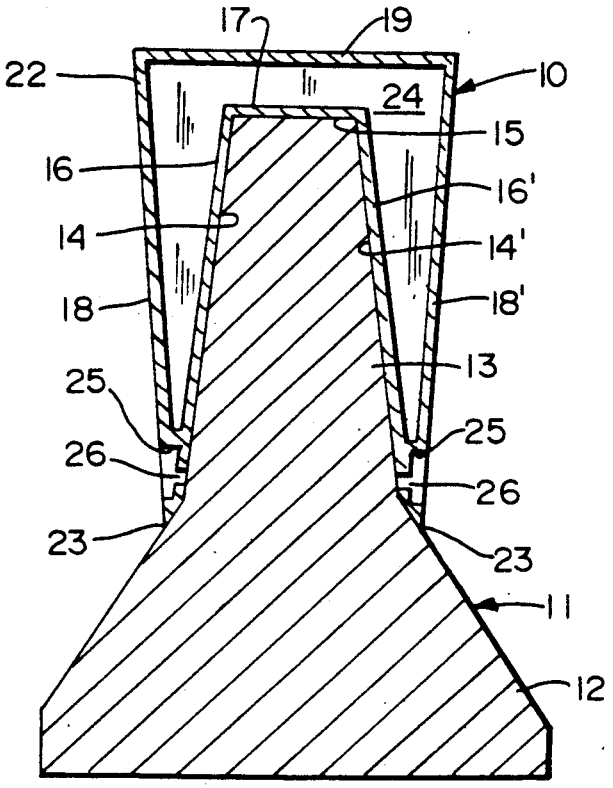
FIG. 4 is a sectional view on the line 4—4 of FIG. 2.

The hollow body of the extension 10 as shown in FIGS. 3 and 4, has opposed inner walls 16, 16' joining top wall 17 adapted to closely engage the surface contour of the upstanding portion 13 of the highway barrier. These inner walls are joined at the lower ends thereof to outer walls 18, 18' connected by the top wall 19, having a central aperture, as seen at 20 in FIG. 1, formed in the molding operation. The top wall 19 is suitably about three inches above the inner top wall 17, and this slight increase in height will increase the effectiveness of the barrier in shielding oncoming headlights.

It will be noted that the outer surfaces 18, 18' are divergently inclined approximately 5° so that the external top wall 19 is substantially wider than the internal top wall 17. The purpose of this divergent inclination is to provide a contact surface which will have the effect of limiting the tendency of contacting vehicles to ride up the barrier, as frequently happens when contacting directly the convergently inclined surfaces 14 or 14' of the barrier.

The outer surfaces 18, 18' are also provided with a sinusoidal curvature, as shown in FIG. 1, with two cycles per unit, with the variation between convex portions 21, and concave portions 22 being about two inches.

It should be noted that the barrier extension as illustrated is about 4 feet long, which means that the curve cycle is approximately 2 feet. The length of the curve cycle should be maintained in larger units; and units 6 feet and 8 feet in length would contain, respectively 3 and 4 curve cycles. Note also that the curves are positioned to locate centers of the concave portions at ends of the unit, whereby convex portions will be uniformly spaced in units assembled in end-to-end relation.

Figure 2:
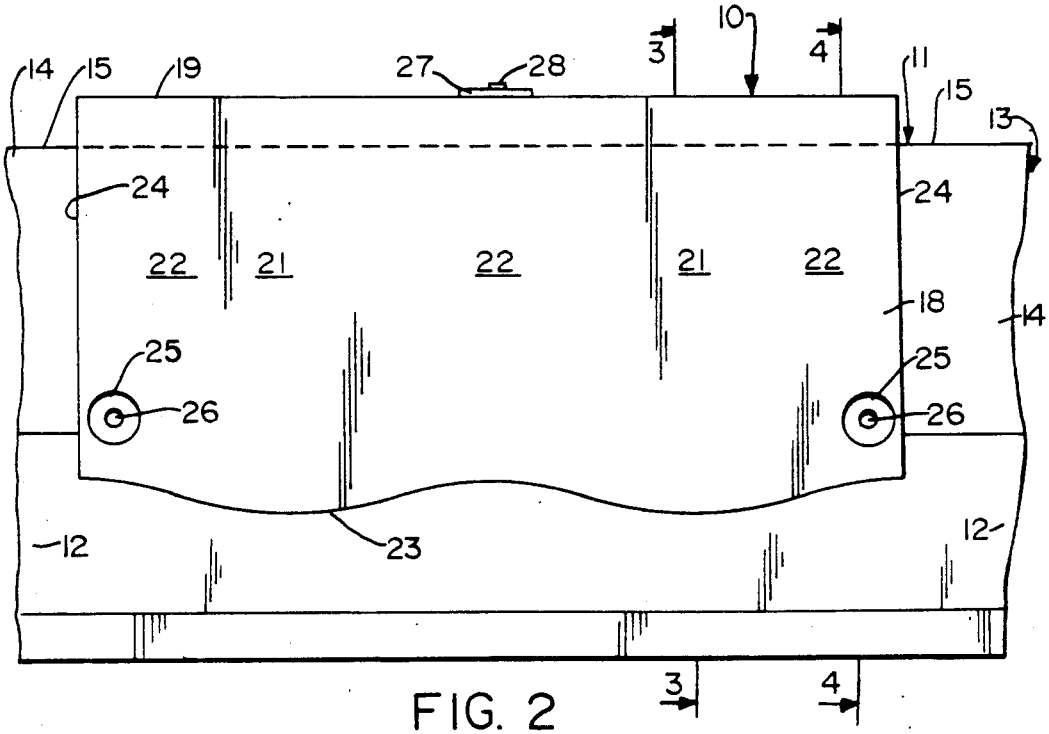
FIG. 2 is a side view of the assemblage shown in FIG. 1.

Because the curved contour of the outer surfaces 18, 18' extend throughout the height of the resilient extension, the bottom edge of the extension also takes on the sinusoidally curved contour as seen at 23 in FIG. 2 of the drawing. This sinusoidally curved outer contour provides the special advantage of giving the motorist an audible and physical warning of glancing contact with the barrier in time to permit the motorist to steer away from the barrier without incurring the type of damage that can result through direct vehicular contact with the concrete barrier. Because of the resilient nature of the sinusoidally curved walls, it is visualized that many glancing contacts can be made, providing audible and physical warnings to motorists without significant damage to either the resilient extension or the contacting vehicle.

End walls 24 of the resilient extension are preferably flat and parallel to each other, as indicated in FIGS. 1 and 2, permitting the units to be closely abutted in end to end relation when being assembled to a barrier 10 which may be of infinitely variable lengths. As mounted to the barrier, the resilient extension can be secured in position by direct bonding to the barrier with a suitable cement, or, if desired, lower corners of the device can be provided with recesses 25, with central apertures 26 for insertion of bolts or other fasteners of the type conventionally used in securing items to concrete.

The central aperture 20 in the top wall is provided with a suitable detachable cover or closure 27 which can, if desired, be provided with a central valve diagramatically shown at 28 permitting the hollow body to be filled with air under pressure, or with water containing anti-freeze to prevent its solidification in cold weather. Either type filling will add appreciably to the impact resistance of the resilient extension, but it is to be understood that, depending upon the nature and wall thickness of the plastic material employed, ample impact resistance may be provided by simply maintaining normal air pressure within the plastic body. In this connection, it is considered that plastic walls approximately ¼" thick as fashioned from polyethylene will provide both structural integrity and effective impact resistance in the resilient extension. Optimum wall thickness will, however, depend on the particular plastic selected as construction material.

While the device has been thus far described as a hollow body, it is within the scope of the invention to fashion the resilient extension as a solid molding of foamed plastic material, which would have inherent resilient characteristics. Such a structure is readily visualized from the drawings as previously described, and the foamed plastic approach would seem to have merit as a practical way of utilizing scrap plastic material in a beneficial way.

It is visualized that this type of resilient extension for concrete highway barriers can greatly increase the safety of highway travel by alerting motorists concerning barrier contact in time to avert the inherently damaging vehicular contact with the concrete barrier itself. It is realized, of course, that accidents will occur resulting in more than glancing contact with the barrier; but even with such contacts, the plastic barrier coating should minimize vehicle damage; and while the resilient extension may be damaged or destroyed by such more violent contact, the section or sections so damaged can be readily replaced.

The safety advantage can be enhanced by imparting distinctive color characterization to the resilient extension. This can be accomplished by incorporating an appropriate coloring agent in the plastic material, or applying it as a coating. The coloring agent should preferably be of the florescent type, which will take on added brightness as illuminated by approaching automotive headlights.

Various changes and modifications in the resilient safety extension for highway barriers as herein disclosed may occur to those skilled in the art, and to the extent that such changes or modifications are embraced by the appended claims, it is to be understood that they constitute a part of the present invention.

I claim:

1. A resilient safety extension for highway barriers, of the type having a broad base and upstanding central portion with opposed convergently tapered surfaces and a length which is infinitely variable, said resilient safety extension comprising an elongated resilient member having an inverted generally U-shaped transverse configuration provided by a top portion and spaced downwardly extending portions adapted to straddle the upstanding portion of the highway barrier, the downwardly extending portions being convergently tapered to provide inner surfaces closely interfitting with the upstanding portion of the barrier and outer surfaces which are slightly divergent in the direction of the top portion, and the thickness of the downwardly extending portions being variable by amounts of the order of 2 inches to provide sinusoidally curved outer surface patterns, repeating at approximately 24" intervals longitudinally of the safety extension, whereby glancing contact by a moving vehicle will generate a physical and audible warning signal without damaging the vehicle.

2. A resilient safety extension for highway barriers as defined in claim 1, wherein each elongated resilient member contains a whole number of sinusoidal curves with the centers of concave portions thereof being at the ends of said members, whereby abutting members will form continuous sinusoidal curves.

3. A resilient safety extension for highway barriers as defined in claim 2, wherein the elongated resilient member has a length within the range of 4 to 8 feet.

4. A resilient safety extension for highway barriers as defined in claim 1, wherein said elongated resilient member is a hollow plastic body with a central top opening having detachable closure means.

5. A resilient safety extension for highway barriers as defined in claim 4, wherein said closure means includes air valve means enabling the body to be filled with compressed air.

6. A resilient safety extension for highway barriers as defined in claim 4, wherein said closure means facilitates filling the hollow body with water, which will contain anti-freeze if used in sub-freezing temperature areas.

7. A resilient safety extension for highway barriers as defined in claim 1, wherein said elongated resilient member is a solid body of plastic material in which the resilient characteristics are provided, in part, by small voids distributed uniformly throughout the body.

8. A resilient safety extension for highway barriers as defined in claim 7, wherein said voids are of generally spherical shape as formed in a foaming process.

9. A resilient safety extension for highway barrier as defined in claim 7, wherein said voids are of widely varied contours as formed in the bonding together of particled plastic scrap material.

10. A resilient safety extension for highway barriers as defined in claim 7, wherein said solid body extends the full length of the barrier.

11. A resilient safety extension for highway barriers as defined in claim 1, wherein lower corners of said downwardly extending portions have recessed apertures for the reception of fasteners for securing the extension to the barrier.

12. A resilient safety extension for highway barriers as defined in claim 1 wherein the inner contours of the extension closely conforming to the outer contours of the barrier facilitates adhesive bonding of the extension to the barrier.

13. A resilient safety extension for highway barriers as defined in claim 1 wherein as an added safety feature said extension is provided with a distinctive and readily visible coloring agent.

14. A resilient safety extension for highway barriers as defined in claim 13, wherein the coloring agent is incorporated in the plastic material of said extension.

15. A resilient safety extension for highway barriers as defined in claim 13, wherein the coloring agent is incorporated in a coating applied to said extension.

16. A resilient safety extension for highway barriers as defined in claim 13, wherein said coloring agent is of the florescent type which will take on added brightness as illuminated by oncoming vehicular headlights.

* * * * *